US010345737B2

(12) United States Patent
Taniya

(10) Patent No.: US 10,345,737 B2
(45) Date of Patent: Jul. 9, 2019

(54) IMAGE FORMING APPARATUS PROVIDED WITH A TONER STORAGE CONTAINER INCLUDING AN INTEGRATED COVER

(71) Applicant: SHARP KABUSHIKI KAISHA, Sakai, Osaka (JP)

(72) Inventor: Keisuke Taniya, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/006,051

(22) Filed: Jun. 12, 2018

(65) Prior Publication Data

US 2018/0364619 A1 Dec. 20, 2018

(30) Foreign Application Priority Data

Jun. 19, 2017 (JP) ..... 2017-119622

(51) Int. Cl.
*G03G 15/08* (2006.01)
*G03G 21/16* (2006.01)

(52) U.S. Cl.
CPC ..... *G03G 15/0875* (2013.01); *G03G 15/0894* (2013.01); *G03G 21/1633* (2013.01); *G03G 21/1676* (2013.01); *G03G 2215/068* (2013.01)

(58) Field of Classification Search
CPC ..... G03G 15/0875; G03G 15/0894; G03G 2215/068; G03G 2215/0872
USPC ..... 399/262; 222/DIG. 1
See application file for complete search history.

(56) References Cited

U.S. PATENT DOCUMENTS

| | | | | |
|---|---|---|---|---|
| 6,246,853 | B1 * | 6/2001 | Suzuki | G03G 15/0896 399/111 |
| 6,968,141 | B2 * | 11/2005 | Fujita | G03G 15/0894 399/109 |
| 9,063,459 | B2 * | 6/2015 | Yamanaka | G03G 15/0875 |
| 9,280,131 | B2 * | 3/2016 | Nakazawa | G03G 21/1676 |
| 2005/0169676 | A1 * | 8/2005 | Oda | G03G 15/0875 399/262 |
| 2006/0171743 | A1 * | 8/2006 | Mori | G03G 15/0875 399/252 |
| 2007/0269238 | A1 * | 11/2007 | Sato | G03G 15/0875 399/263 |
| 2009/0180816 | A1 * | 7/2009 | Sato | G03G 15/0896 399/260 |
| 2012/0243913 | A1 * | 9/2012 | Murata | G03G 15/0875 399/263 |

FOREIGN PATENT DOCUMENTS

JP 2014-209268 A 11/2014

* cited by examiner

*Primary Examiner* — Robert B Beatty
(74) *Attorney, Agent, or Firm* — ScienBiziP, P.C.

(57) ABSTRACT

An image forming apparatus provided with a toner storage container that stores a toner includes an integrated cover that includes a top part configured to be fixed to an upper surface of the toner storage container and a cover part for a front surface of the toner storage container. The top part and the front cover part are integral with each other. The integrated cover is held by the toner storage container during fixing of the top part of the integrated cover to the toner storage container.

4 Claims, 5 Drawing Sheets

IMAGE FORMING APPARATUS PROVIDED WITH A TONER STORAGE CONTAINER INCLUDING AN INTEGRATED COVER

BACKGROUND

1. Field

The present disclosure relates to an image forming apparatus provided with a toner container that stores a toner.

2. Description of the Related Art

In general, an electrophotographic image forming apparatus performs developing by supplying a toner from a developing device to an electrostatic latent image formed on a surface of a photoreceptor drum. The toner used in the developing process is supplied from a toner storage container (toner cartridge) to the developing device. Thus, the toner storage container is detachably attached to the image forming apparatus.

As described in Japanese Unexamined Patent Application Publication No. 2014-209268, there is a toner storage container in which a top is welded to an upper surface of a toner cartridge, and then, a front cover is attached to a front surface of the toner cartridge.

The front cover has a shape that enables a user to easily grab the front cover when extracting the toner cartridge from an image forming apparatus.

Such a toner cartridge, however, includes a large number of components because the top and the front cover are provided as separate components, which affects efficiency of assembling work.

Moreover, the cover that covers the front surface of the toner cartridge holds the cover itself by using a component thereof and thus includes a component such as a pawl. As a result, both the mass and the weight of the cover are increased, which hinders weight-saving.

SUMMARY

Considering the above circumstance, it is desirable to provide an image forming apparatus that enables a reduction in the number of components of a toner storage container and a reduction in weight.

According to an aspect of the disclosure, there is provided an image forming apparatus provided with a toner storage container that stores a toner, the image forming apparatus including an integrated cover that includes a top part configured to be fixed to an upper surface of the toner storage container and a cover part for the toner storage container, the top part and the cover part being integral with each other; and a lock structure with which the integrated cover is held by the toner storage container during fixing of the top part of the integrated cover to the toner storage container.

DESCRIPTION OF THE EMBODIMENTS

Hereinafter, an embodiment of the present disclosure will be described with reference to the attached drawings.

Figure 1:
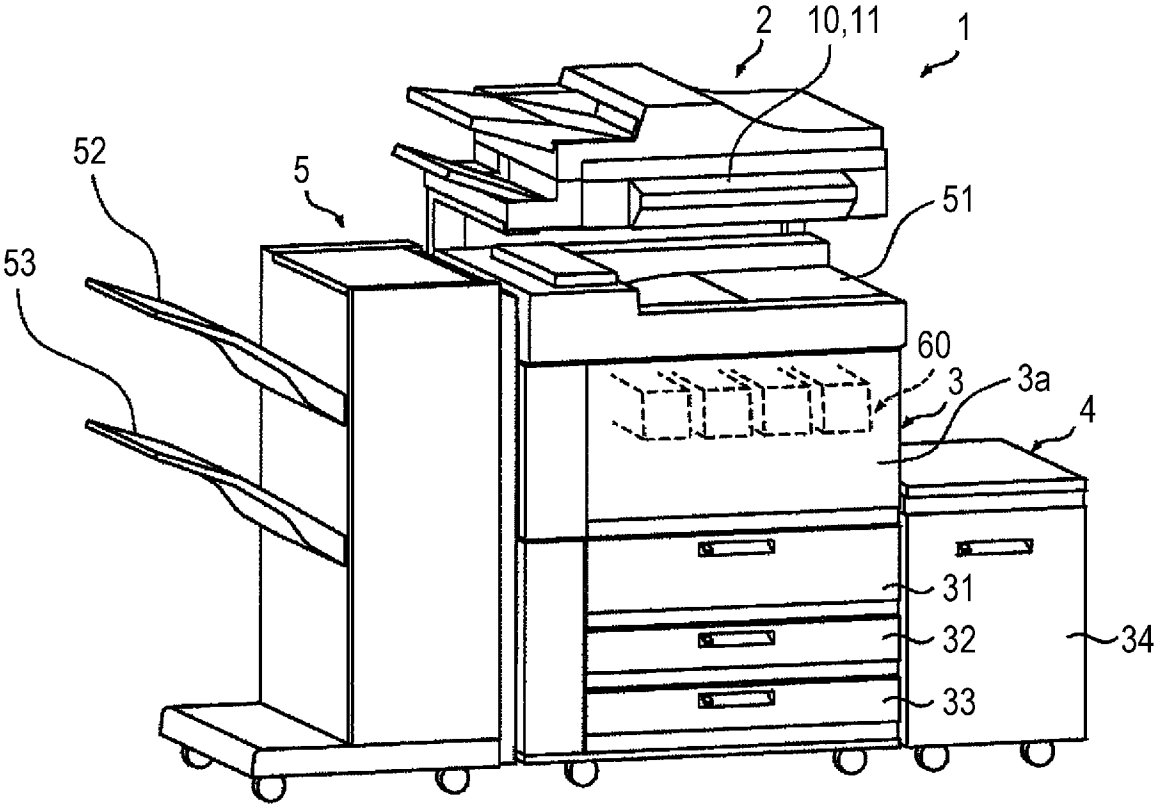
FIG. 1 is a view illustrating an overall structure of an image forming apparatus according to an embodiment of the present disclosure.
Figure 2:
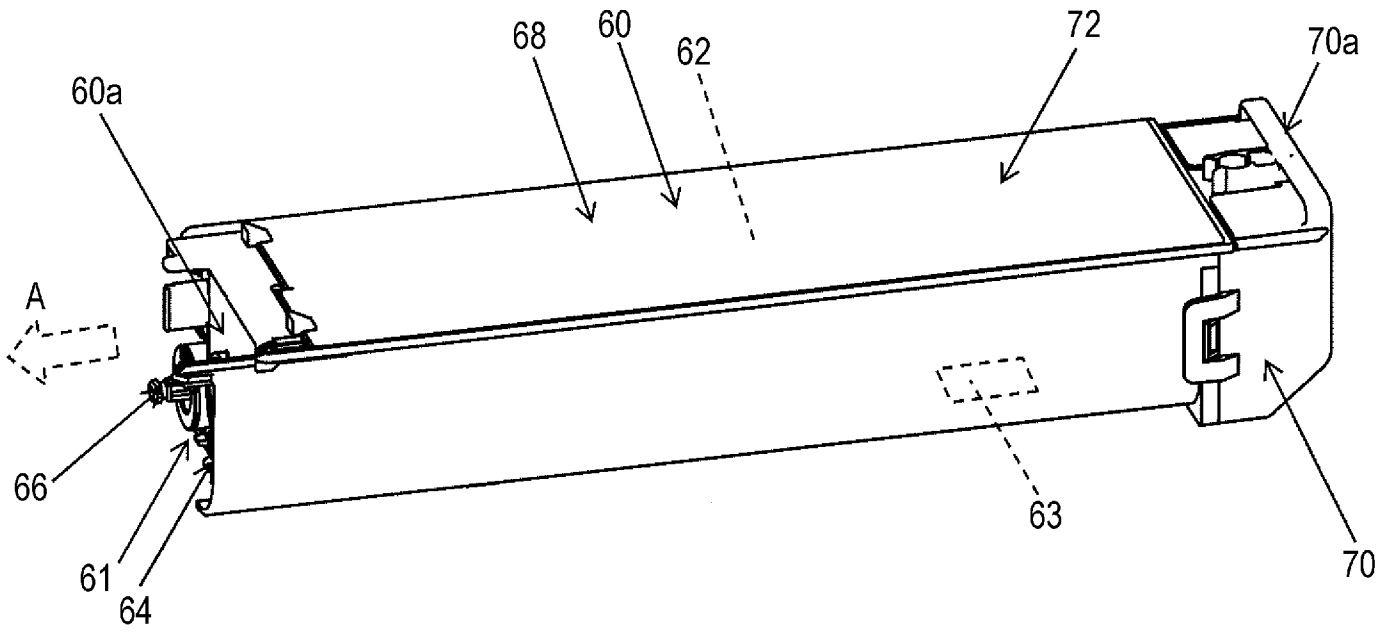
FIG. 2 is a view illustrating a structure of a toner cartridge configured to be loaded on the image forming apparatus.
Figure 3:
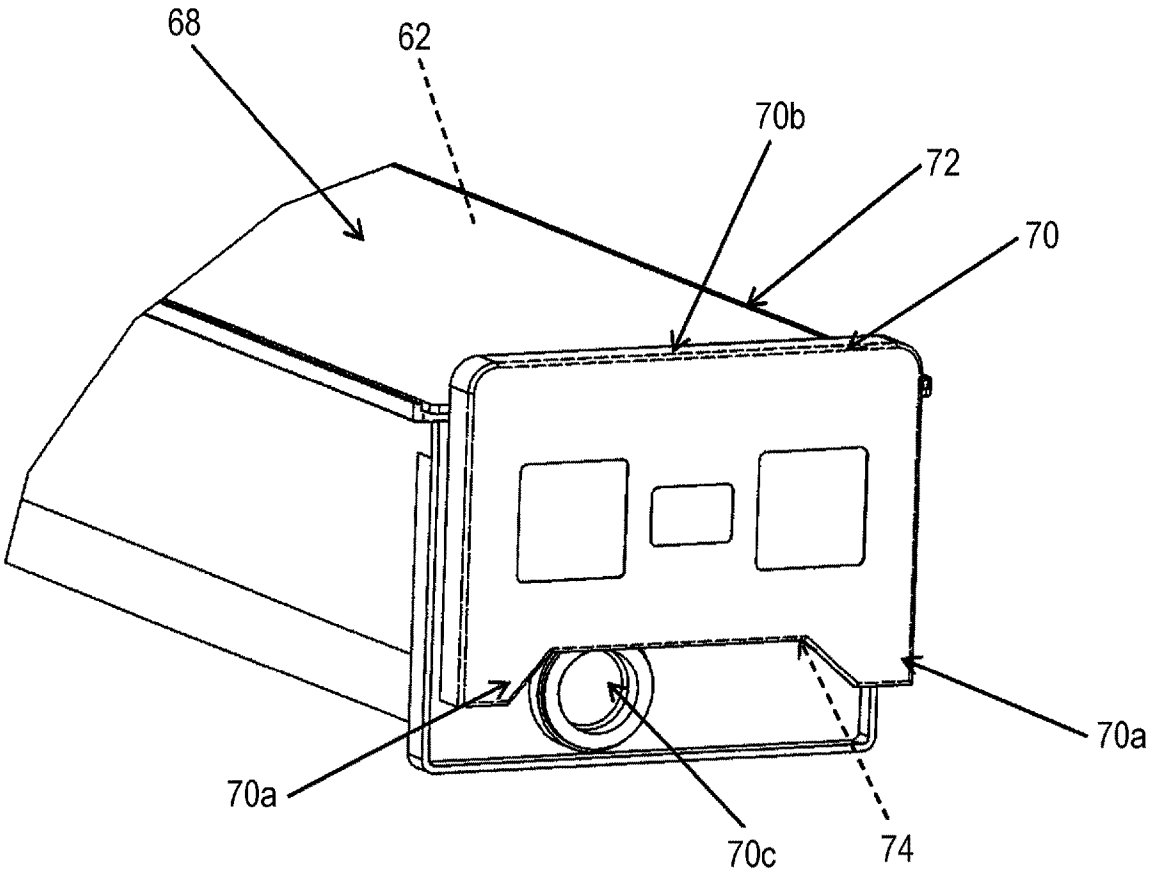
FIG. 3 is a view from the front cover part, partially illustrating an integrated cover of the toner cartridge.
Figure 4:
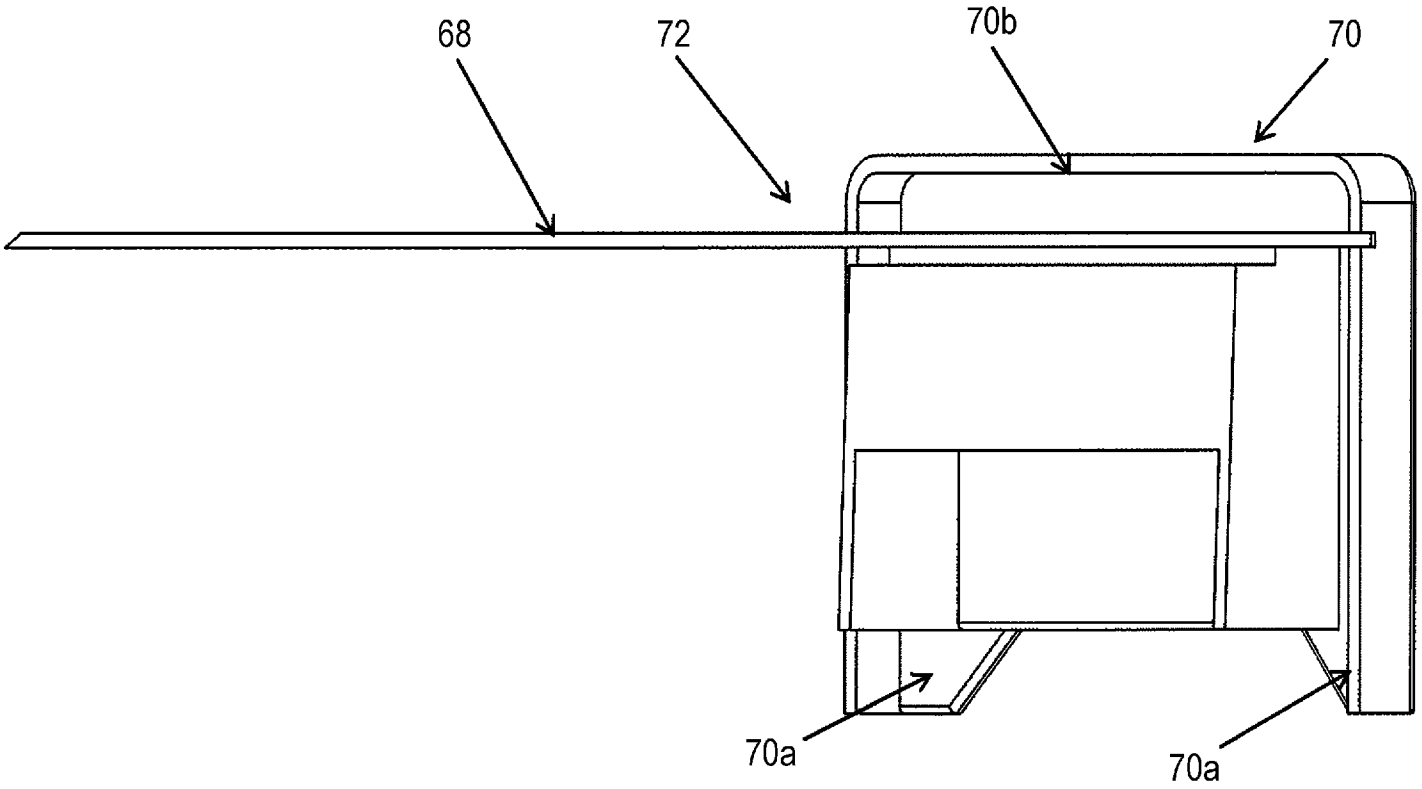
FIG. 4 is a view from the rear of the front cover part, partially illustrating the integrated cover.
Figure 5:
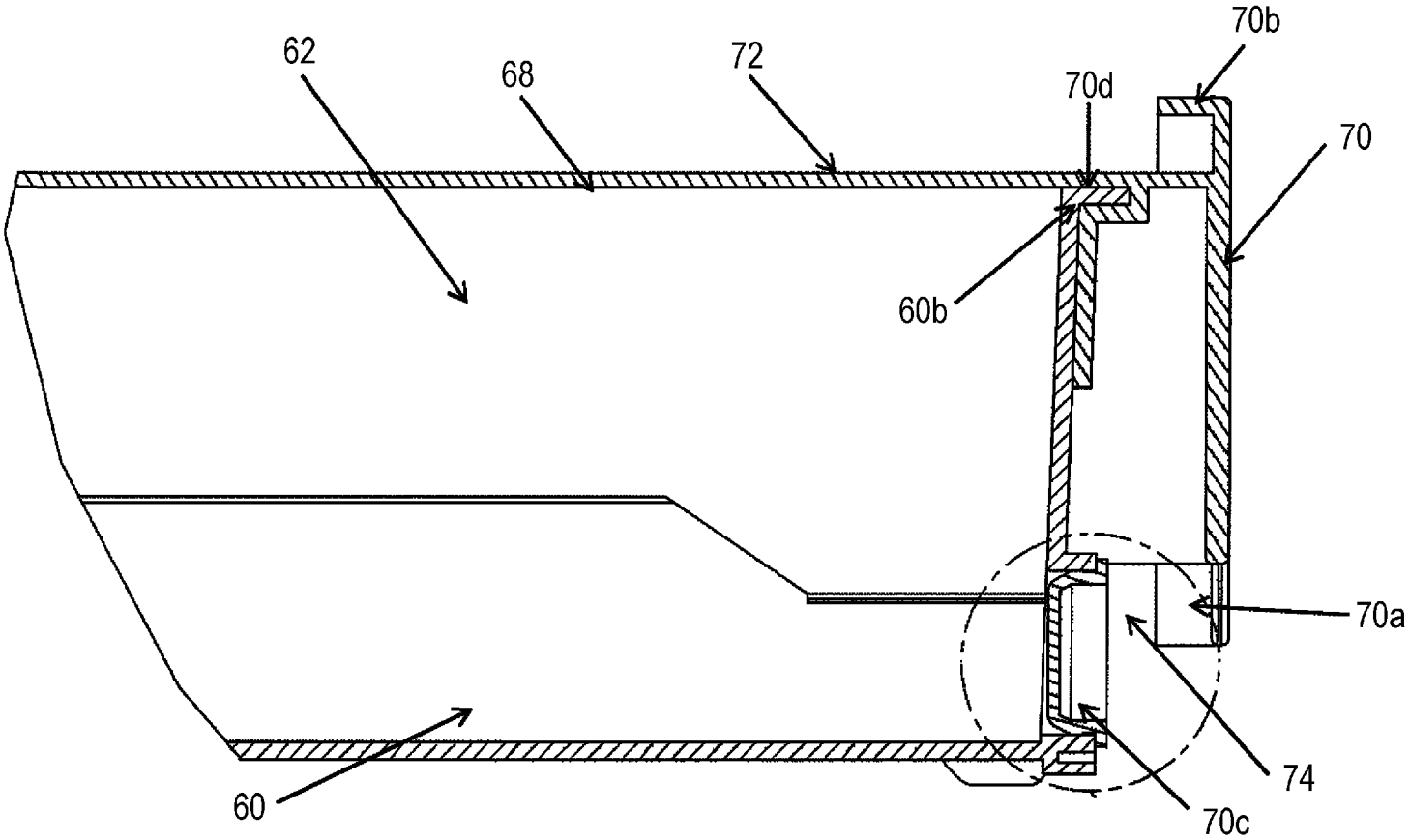
FIG. 5 is a sectional view around a toner cartridge attachment portion of the integrated cover.

FIG. 1 is an overall view of an image forming apparatus according to the present embodiment. FIGS. 2 to 5 are views each illustrating a toner cartridge. FIG. 2 is a view illustrating a structure of the toner cartridge. FIG. 3 is a view from a front cover part, partially illustrating an integrated cover of the toner cartridge. FIG. 4 is a view from the rear of the front cover part, partially illustrating the integrated cover. FIG. 5 is a sectional view around a toner cartridge attachment portion of the integrated cover.

The image forming apparatus according to the embodiment relates to an image forming apparatus provided with a toner storage container that stores a toner.

First, with reference to FIG. 1, an overall structure of an image forming apparatus 1 will be described.

The image forming apparatus 1 is configured to form an image on a predetermined sheet (recording sheet, recording medium) in accordance with image data transmitted from the outside. As illustrated in FIG. 1, the image forming apparatus 1 includes, for example, an image formation processing part 3 that includes an electrophotography processor (not illustrated), which is a body apparatus, and an image reading part 2 that includes an operation panel 10 and a scanner unit (not illustrated).

The image data that is obtained by reading a document image with the scanner unit is temporarily stored in a memory after being subjected to various types of processing. In accordance with an output instruction, the image data is output from the memory to the image formation processing part 3, and an electrostatic latent image on a photoreceptor drum (not illustrated) is developed and reproduced by a toner image as a visible image. Then, the toner image is transferred and formed on a sheet.

The image formation processing part 3 includes an openable outer cover 3*a* and is provided with an open/close sensor (not illustrated) that detects an open/close state of the outer cover 3*a*.

A sheet feeding part 4 that supplies a sheet is disposed adjacent to the image formation processing part 3.

The sheet feeding part 4 includes first to third cassettes 31, 32, and 33, and a large-capacity cassette 34 as an option. The large-capacity cassette 34 is capable of storing a large quantity of standard sheets of the most frequently used size, for example, the A4 size.

A sheet discharge tray 51 is disposed between the image reading part 2 and the image formation processing part 3.

A post-processing apparatus 5 is disposed adjacent to the image formation processing part 3.

The post-processing apparatus 5 includes a first sheet-discharge tray 52 and a second sheet-discharge tray 53.

The operation panel 10 includes an operation surface (input part), and a display part 11 is formed at a substantially center portion of the operation surface. The display part 11 may not be flush with the operation surface (input part), may be openable, closable, and movable with respect to the operation surface, and may be provided separately from the operation surface. Moreover, the operation surface and the display part 11 may be combined together.

At least one toner storage container (also called toner cartridge) 60 is disposed inside the image formation processing part 3. In a case where the image formation processing part 3 is configured to form a color image, a plurality of the toner storage containers 60 (for example, the toner storage containers 60 for each color (cyan C, magenta M, yellow Y, black K, and the like)) are disposed.

As illustrated in FIG. 1, the at least one toner storage container 60 used in the image forming apparatus 1 is disposed inside the image formation processing part 3 so as to be detachable therefrom. The outer cover 3*a* is opened during attaching and detaching of the toner storage container 60.

As illustrated in FIG. 2, the toner storage container 60 is a hollow substantially columnar body and stores a replenishment toner in an internal space (toner storage part 62).

A toner replenishing port 63 is provided at a bottom portion (lower side in FIG. 2) of the toner storage part 62. The toner storage container 60 has one end portion 60*a* that is directed and attached to a body of the image forming apparatus 1. A memory part (memory unit) 61, such as an IC chip, in which information on consumable items is stored, is disposed at the one end portion 60*a*.

As illustrated in FIG. 2, a memory part positioning boss 64 is disposed at the memory part 61. The memory part positioning boss 64 is a member for positioning the memory part 61 with respect to a memory part connector (not illustrated) disposed at the body of the image forming apparatus 1 during attaching of the toner storage container 60 to the image forming apparatus 1.

Toner replenishment from the toner storage container 60 to an outside part is performed by driving a toner transport motor (not illustrated) to rotate a toner transport member (an end portion 66 thereof is illustrated in FIG. 2), thereby replenishing the toner to the outside part through the toner replenishing port 63 disposed at the lower portion of the toner storage container 60. The toner storage container 60 is configured to be attached in the arrow A direction toward the inside of the image formation processing part 3 in the body of the image forming apparatus 1.

Here, as illustrated in FIGS. 2 to 4, the toner storage container 60 includes an integrated cover 72. The integrated cover 72 includes a top part 68 configured to be fixed to the upper surface of the toner storage container 60 to close the upper surface and a front cover part 70 configured to be attached to the front surface of the toner storage container 60. The top part 68 and the front cover part 70 are integral with each other. The toner storage container 60 has a substantially box shape with an upper portion thereof open in a state in which the integrated cover 72 is detached therefrom. As illustrated in each of FIGS. 2 and 5, the upper portion of the toner storage container 60 is closed by the top part 68, and the front cover part 70 is attached to a front portion of the toner storage container 60. In this case, the front portion is opposite to the attachment direction (arrow A direction) in FIG. 2.

As illustrated in FIG. 5, the front cover part 70 of the integrated cover 72 includes a protruding portion 70*a* protruding downward. Thus, in a state in which the integrated cover 72 is attached to the toner storage container 60, a gap 74 is present between the protruding portion 70*a* of the front cover part 70 and a wall surface of the toner storage container 60. The gap 74 opens downwardly. The front cover part 70 has a shape that enables easy extraction of the toner storage container 60 from the image forming apparatus 1 because it is possible to extract the toner storage container 60 toward the front by placing a hand in the gap 74 of the front cover part 70 and catching the protruding portion 70*a*. Thus, the toner storage container 60 is easily extracted from the image forming apparatus 1 and easily handled because the front cover part 70 includes the protruding portion 70*a*, which is a portion configured to be caught by a hand during extraction of the toner storage container 60 attached to the image forming apparatus 1. The protruding portion 70*a* has a substantially bifurcated shape to enable easy insertion of fingers into the gap 74.

The toner storage container 60 includes a projection 60*b* at an upper end portion thereof as a lock structure with which the integrated cover 72 is held by the toner storage container 60 during fixing of the top part 68 of the integrated cover 72 to the toner storage container 60. A recess 70*d* into which the projection 60*b* is fitted is formed at an upper portion of the front cover part 70 of the integrated cover 72. The projection 60*b* is fitted into and engaged with the recess 70*d* to enable the front cover part 70 of the integrated cover 72 to be firmly fixed to the toner storage container 60.

Moreover, during fixing of the top part 68 to the upper surface of the toner storage container 60 by ultrasonic welding, when the front cover part 70 integral with the top part 68 covers a side surface of the toner storage container 60, the front cover part 70 may be locked to the toner storage container 60 with the projection 60*b*, which is the lock structure, to hold the integrated cover 72.

Further, the front cover part 70 may include an upper portion 70*b* that protrudes upward from an upper surface of the top part 68. The protruding upper portion 70*b* may be also a protruding portion that is configured to be caught by a hand to enable easy extraction.

The upper portion 70*b* of the front cover part 70 may have an upper surface that is chamfered (formed into an R surface) into a substantially streamline shape. Consequently, the front cover part 70 does not catch during attaching and detaching to and from the image forming apparatus 1, which enables smooth insertion and extraction.

As illustrated in FIGS. 3 and 5, a toner injection port 70*c* may be provided at the front cover part 70. The injection port 70*c* is closable with, for example, a cap after a toner is input therethrough.

The integrated cover 72 is held by the toner storage container 60 during fixing of the top part 68 of the integrated cover 72 to the toner storage container 60. Specifically, during setting of the integrated cover 72, the front cover part 70 is fitted to the front portion of the toner storage container 60, and the top part 68 is placed over an upper surface opening of the toner storage part 62. The projection 60*b* is formed, as the lock structure, at the upper end portion of the front surface of the toner storage container 60. During fitting of the front cover part 70, the projection 60*b* is engaged with the front cover part 70 to temporarily avoid the movement of the integrated cover 72 with respect to the toner storage container 60, thereby avoiding displacement of the integrated cover 72 during ultrasonic welding of the top part 68.

The top part 68 has a size equivalent to that of the upper surface opening of the toner storage container 60 and thus is capable of closing the upper surface opening without a gap.

That is, the integrated cover 72 is configured to cover the front surface of the toner storage container 60 with the front cover part 70 integral with the top part 68 during ultrasonic welding of the top part 68 that is disposed on the upper surface of the toner storage container 60 to the toner storage container 60. Thus, it is possible to perform ultrasonic welding of the top part 68 with a simple configuration easily with high accuracy and without using a special tool for positioning because it is possible to perform positioning by placing the integrated cover 72 on the toner storage container 60 and by fitting the front cover part 70 thereto.

According the image forming apparatus 1 in the embodiment, two conventional processes of welding the top and attaching the front cover are performed by only welding the top part 68 in the embodiment because the top part 68 of the upper portion and the cover part 70 of the front surface are integrated with each other, which improves efficiency. In addition, a part such as a pawl is not used because the top part 68 and the front cover part 70 are integrated with each other, which enables the mass and the weight of the integrated cover 72 to be less than those of a conventional cover. Moreover, during fixing of the top part 68 of the integrated cover 72 to the toner storage container 60, the integrated cover 72 is held by the toner storage container 60, and thus, positioning during fixing work becomes easy. As a result, an effect that enables easy attachment and that improves work efficiency is exhibited.

The image forming apparatus according to the present disclosure is applicable to a toner storage container of an image forming apparatus that forms monochromatic or color toner images.

The present disclosure contains subject matter related to that disclosed in Japanese Priority Patent Application JP 2017-119622 filed in the Japan Patent Office on Jun. 19, 2017, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming apparatus provided with a toner storage container that stores a toner, the image forming apparatus comprising:

an integrated cover that includes a top part configured to be fixed to an upper surface of the toner storage container and a front cover part configured to cover an end of a columnar body of the toner storage container, the top part and the front cover part being integral with each other; and a lock structure with which the integrated cover is held by the toner storage container during fixing of the top part of the integrated cover to the toner storage container.

2. The image forming apparatus according to claim 1, wherein the lock structure is a structure with which the integrated cover is held when the cover part integral with the top part covers a side surface of the toner storage container and is locked to the toner storage container, during fixing of the top part to the upper surface of the toner storage container by ultrasonic welding.

3. The image forming apparatus according to claim 1, wherein the cover part includes a protruding portion configured to be caught by a hand during extraction of the toner storage container from the image forming apparatus.

4. The image forming apparatus according to claim 1, wherein the front cover part has a chamfered upper portion.

* * * * *